US005544982A

United States Patent [19]

Seegmiller

[11] Patent Number: 5,544,982

[45] Date of Patent: Aug. 13, 1996

[54] MINE STRATA SUPPORT STRUCTURE

[76] Inventor: Ben L. Seegmiller, 143 S. 400 East, Salt Lake City, Utah 84111

[21] Appl. No.: 345,566

[22] Filed: Nov. 25, 1994

[51] Int. Cl.[6] ..... E21D 21/00

[52] U.S. Cl. ..... 405/288; 405/302.2

[58] Field of Search ..... 405/288, 302.1, 405/302.2, 302.3, 259.1

[56] References Cited

U.S. PATENT DOCUMENTS

| | | | |
|---|---|---|---|
| 4,596,496 | 6/1986 | Tyrell et al. | 405/288 |
| 4,699,547 | 10/1987 | Seegmiller | 405/288 |
| 4,934,873 | 6/1990 | Calandra | 405/288 |
| 4,960,348 | 10/1990 | Seegmiller | 405/288 X |
| 5,026,217 | 6/1991 | Seegmiller | 405/288 |
| 5,176,473 | 1/1993 | Seegmiller | 405/288 |
| 5,302,056 | 4/1994 | Calandra et al. | 405/288 |

*Primary Examiner*—John A. Ricci
*Attorney, Agent, or Firm*—M. Ralph Shaffer

[57] ABSTRACT

Mine strata support structure and components in a mine truss and including a mine bracket and a connector, the latter preferably being in the form of an elongated stirrup; the mine bracket, stirrup and associated structure are constructed and dimensioned such that the stirrup may be brought into retentive engagement with the bracket and not slip inadvertently out of engagement; this can be produced through the employment of a depending projection which vertically depends from the bearing plate of the bracket, such projection serving with the body of the bracket to supply an access path for stirrup installation, the projection deterring excess rearward travel of the stirrup whereby to maintain bracket-stirrup inter-engagement, and thus truss-integrity, even during conditions of mine strata shock.

19 Claims, 4 Drawing Sheets

MINE STRATA SUPPORT STRUCTURE

FIELD OF INVENTION

The present invention relates to new and useful mine strata support structure and components thereof and, more particularly, presents a bracket, generally a mine roof bracket, that is provided a bearing plate and a depending body having a rearward pocket indentation. A connector, generally in the form of a U-configured stirrup, inter-engages with the bracket, the bracket being supplied with a stop or travel delimiting structure, generally spaced from the body, whereby to deter excessive rearward travel of the stirrup that would chance decoupling of the stirrup from the bracket.

DESCRIPTION OF PRIOR ART

A number of different types of trussing structures, whether useful in active or passive mode, or both, has previously been devised and extensively used in underground mines. A variety of brackets and connectors of prior design have been employed for achieving the trussing and/or support function desired.

One such prior structure is disclosed in the inventor's prior U.S. Pat. No. 5,026,217, issued Jun. 25, 1991 and entitled MINE ROOF SUPPORT TRUSS AND COMPONENTS. Other structures are shown an another of the inventor's patents, see U.S. Pat. No. 5,176,473, issued Jan. 5, 1993 and entitled MINE ROOF TRUSS AND COMPONENTS. The disclosures of both of these patents are fully incorporated herein by way of reference. In connection with the truss system shown in these patents as well as trussing systems shown in other literature, there may occur the problem of "bumps" or minor earthquakes in the mine strata, which infrequently can occur, owing to a shift or cleavage in the mine roof strata. Indeed, there can occur a situation wherein the trussing system will experience, momentarily, considerable slack, on account of which the connector such as a stirrup will travel rearwardly relative to the bracket pocket so as to chance disengagement altogether of the stirrup or other connector with the bracket. In such event, the stirrup and the tie rod structure associated therewith may chance to fall downwardly, thus negating the truss effect and actually constitute a safety hazard to mine personnel.

BRIEF DESCRIPTION OF INVENTION

According to the present invention, the truss system includes mine brackets and connectors, e. g. stirrups, wherein structural design facilitates selective engagement and also disengagement of a stirrup from the bracket, but wherein component structures are dimensioned so as to preclude the inadvertent disengagement of the stirrup from the bracket during instances of strata-shock when temporary slack is experienced by the truss. In one form of the invention the respective mine brackets include a depending vertical protuberance which is generally integral with the bearing plate of the respective bracket. This depending protuberance or projection serves as a travel stop to delimit the rearward travel of the stirrup or other connector such that the stirrup cannot become disengaged from the body of the mine bracket once the struss is operationally installed; yet, the depending protrusion is positioned relative to the bracket body, for example, so as to supply sufficient space for the stirrup to be preliminarily inserted, as through a structurally formed passageway, such that the stirrup can be installed and also disassembled relative to the body of the bracket.

The bracket itself, in one form of the invention, may have a body provided with a rearwardly extending portion having an upper periphery formed as a cradle, i.e. with the lower portion having in this regard an upstanding lip. Accordingly, for portage of the bracket and its stirrup, the latter may hang vertically from the cradle of the bracket so that a workman can easily carry the combination to a desired point for bracket securement. Alternatively, the lower portion of the body of the bracket may include laterally extending, essentially horizontal ears or projections which serve to keep the stirrup from becoming disengaged relative to the bracket. In either or both instances, in the present invention the depending stop-projection, depending from the bearing plate of the mine roof bracket, is spaced rearwardly, in one form of the invention, from the rearward terminal of the lower portion of the bracket body so as to provide a vertical passageway whereby the stirrup can be easily slipped into the passageway and later rotated and positioned in place for engagement with the bracket body at its reward indentation. However, the lower portion of the bracket body will be configured, whether by ears, lip, or otherwise, or structural components are constructed, dimensioned and arranged, such that when a strata "bump" occurs, the stirrup's travel rearwardly is delimited by the downward projection or stop, above described, such that for normal operating conditions of the truss, the stirrup will in nowise become disengaged from the bracket body. Generally speaking, and in one form of the invention, there will be an overlap and thus an interference as between the rear curved portion of the stirrup and the lower portion of the bracket body. The stirrup is likewise designed for ease of fabrication and satisfactory performance for tie rods of enlarged diameter. In the larger view, the invention herein comprehends all bracket-connector structures where a stop is provided, relative to the connector, e. g. stirrup, so as to preserve bracket-connector connection even during periods of the existence of structural slack.

OBJECTS

Accordingly, a principle object of the present invention is to provide new and improved truss structure.

The further object is to provide, in one form of the invention, a mine bracket having a bearing plate and body extending therefrom and integral therewith, the bracket also including a depending protrusion proximate to but spaced from the rearmost area of the bracket body, whereby to delimit connector travel in the event of slack being developed in a truss incorporating the bracket.

A further object is to provide a bracket equipped with one of several types of structure, whereby the bracket is useful for vertical portage of a stirrup cradled thereby and, most importantly, wherein a vertical stop projection depends from the bearing plate of the bracket and is spacedly disposed, relative to a receiving indentation, forming a reaction surface, of the bracket whereby vertical travel of a stirrup, mounted over the bracket body is delimited in extent, the lower portion of the bracket being configured so as to overlap or interfere with any inadvertent downward travel or dropping off of the rearward portion of the stirrup for all operating conditions of the truss within which the stirrup and bracket are employed.

An additional object is to provide and improved stirrup connector for mine trusses.

A further object is to provide an improved mine bracket, useful particularly in mine roofs although not delimited in such usage, wherein the same incorporates restraining structures so as to delimit a connector movement relative to the bracket during periods of mine strata shock and/or stratashift.

A further object of the present invention is to provide new and improved mine truss components, whether the truss be of active or passive nature.

An additional object is to provide a new and improved mine bracket.

A further object is to provide a new and improved stirrup structure for use in mining structures.

An additional object is to provide an improved combination of stirrup and mine roof bracket wherein the components are dimensioned and configured such that the stirrup will not become disengaged inadvertently from the bracket once the combination of the stirrup and bracket are installed and a truss containing the same is operationally disposed in place.

A further object is to provide a mine roof bracket having depending projection disposed rearwardly of the bracket body and mutually spaced therefrom so as to provide a travel path for a stirrup to be installed on the bracket body, yet delimit the rearward travel of such stirrup so that the stirrup does not become inadvertently disengaged from the bracket body.

A further object is to provide a mine bracket having a bearing plate and a body integral and depending therefrom, the body including a rearward reaction surface and a lower portion, such lower portion being configured, whether by upstanding lip, lateral ears, or otherwise, to accommodate both portage of a stirrup when in vertical hanging position and also, owing to the vertical projection inclusion, accommodating passageway insertion of the stirrup for mounting purposes, yet delimiting rearward travel of such stirrup during truss installation and operation whereby to maintain bracket-stirrup inter-engagement.

IN THE DRAWINGS

The present invention may best be understood by reference to the following detailed description, taken in connection with the following drawings in which.

Figure 2:
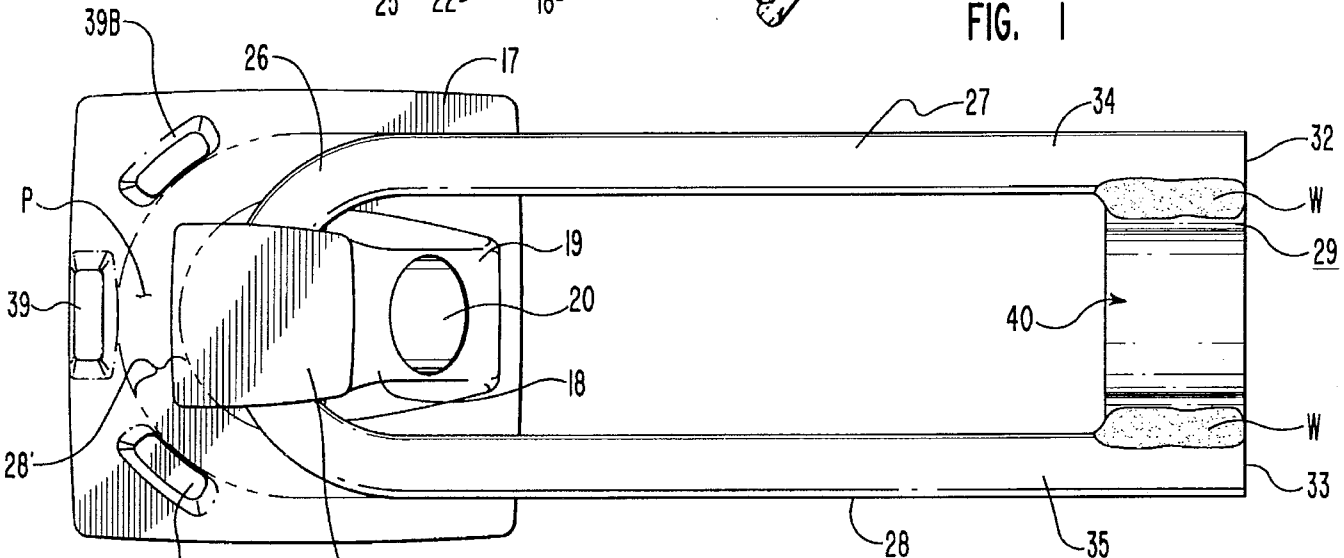
FIG. 2 is a bottom view, looking upwardly, of the bracket and stirrup of FIG. 1, the phantom lines representing an extension of the stirrup illustrating that rearward travel of the stirrup is delimited, owing to one or more depending stop-abutments or projections disposed rearwardly of the bracket body.
Figure 4:
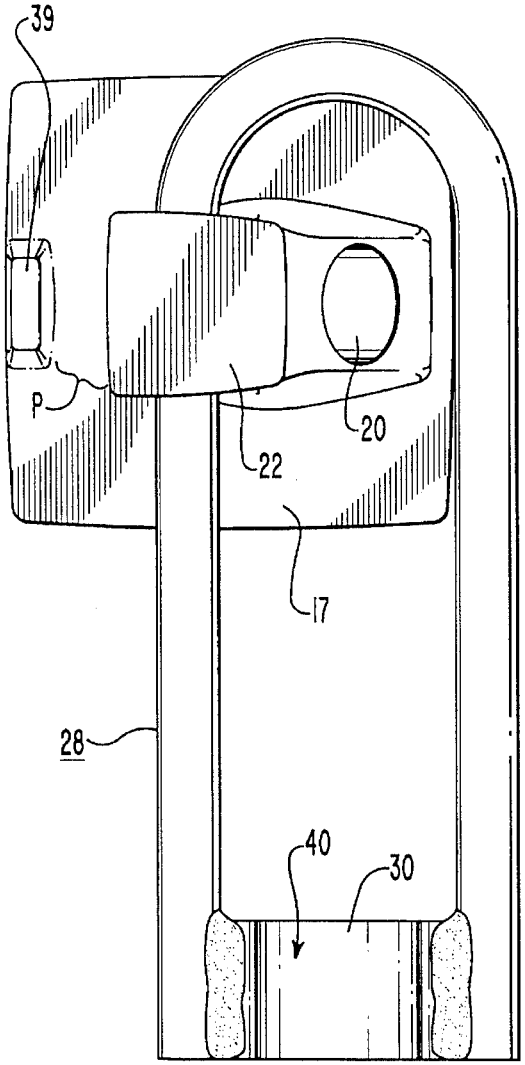
Figure 5:
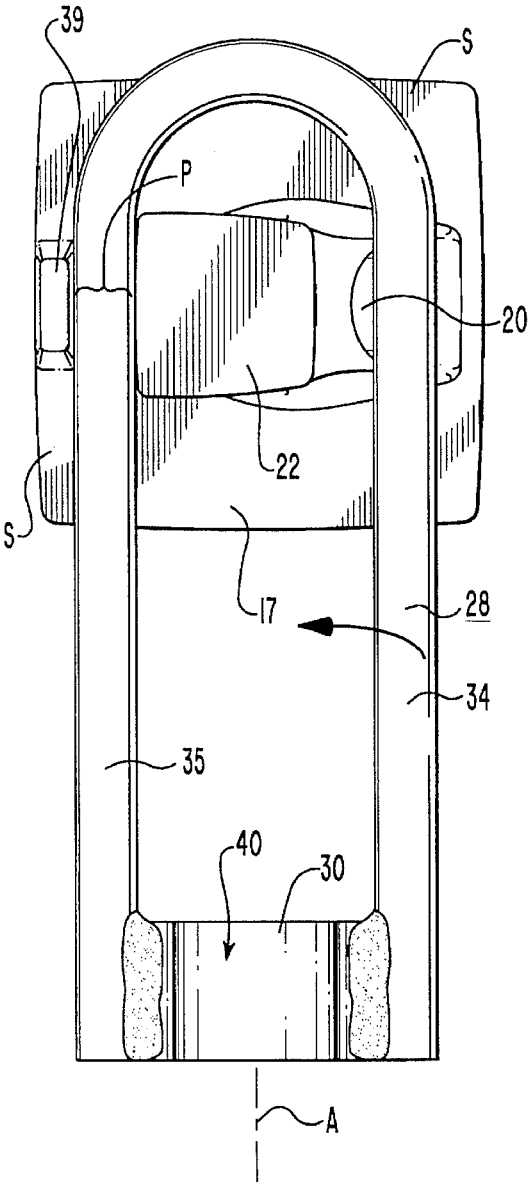

FIGS. 4 and 5 are each respectively similar to FIG. 2, but with a single depending projection being employed, and illustrate that when the stirrup and mine roof bracket are aligned in quadrature or 90 degree relationship, the stirrup can be advanced from the position shown in FIG. 4 to the position seen in FIG. 5, whereby a leg of the stirrup comes up through the travel path proved between the depending projection and the lower portion of the bracket body.

Figure 1:
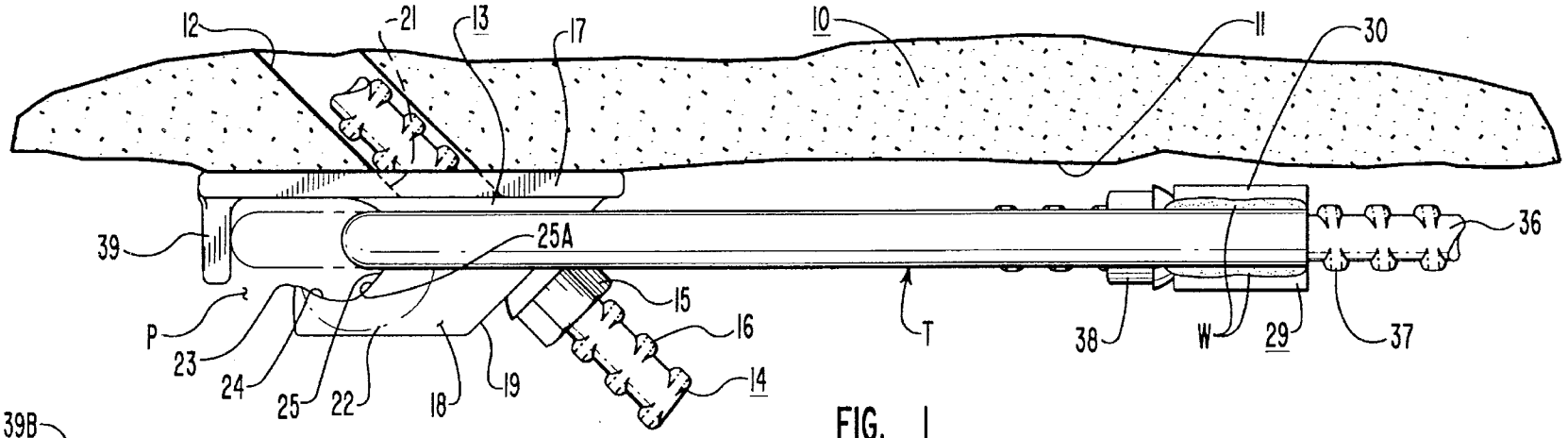
FIG. 1 is a side elevation, partially in section, of a portion of a mine roof truss installed against the roof of mine strata, the truss incorporating the mine roof bracket and stirrup or connector of the present invention.
Figure 6:
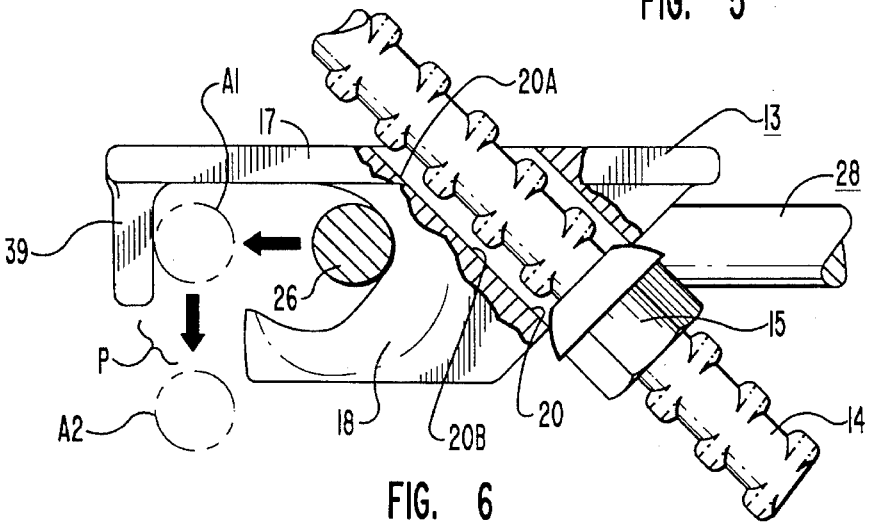

FIG. 6 is a detail of the structure to the left side of FIG. 1 illustrating that, upon successive rotations, the central curved portion of the stirrup can be advanced rearwardly and downwardly for obtaining stirrup release; alternatively, the stirrup can be installed or re-installed in similar manner, the direction of the arrows of course being reversed as to direction.

Figure 7:
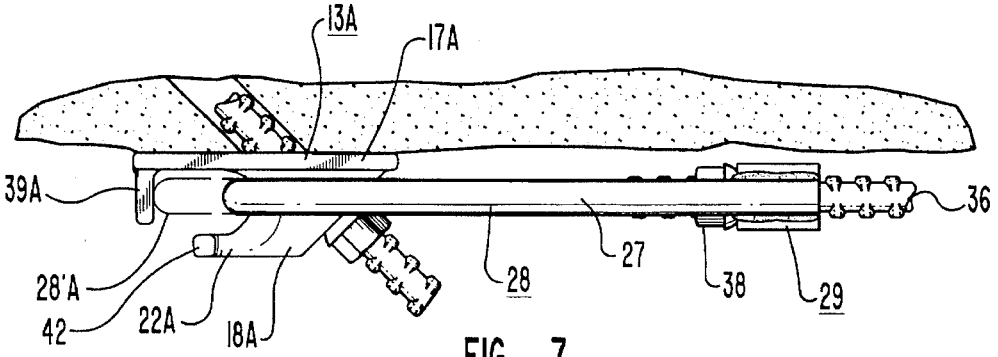

FIG. 7 is similar to FIG. 1, is in reduced scale, and illustrates an alternate bracket configurement.

Figure 8:
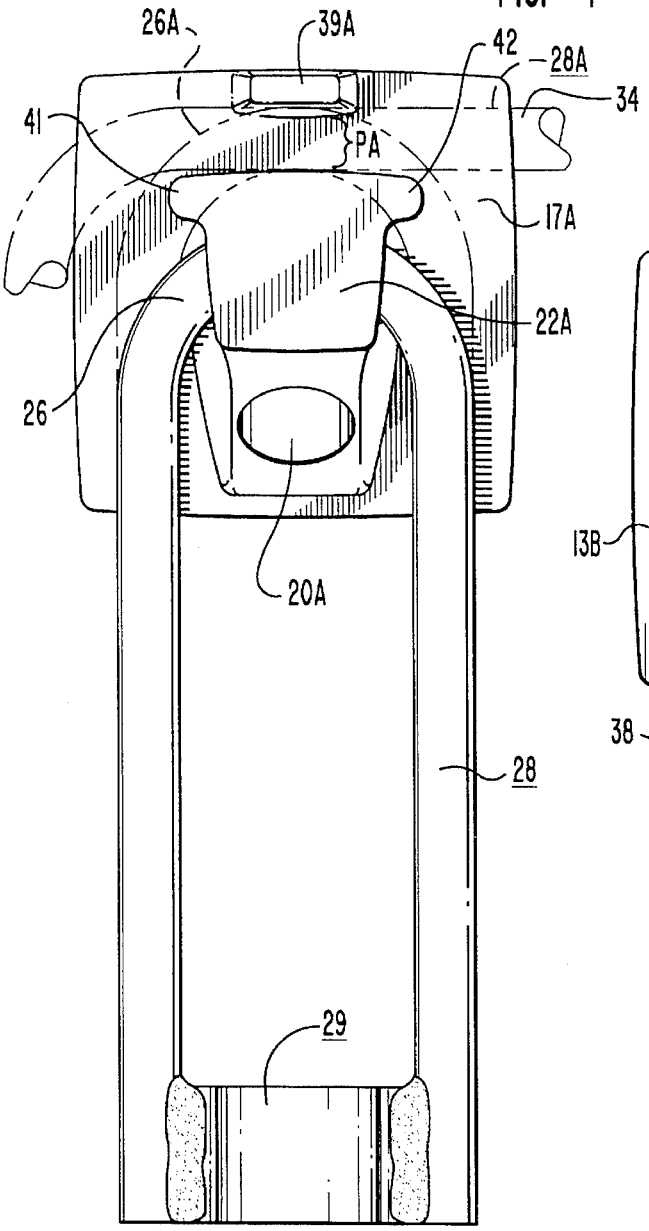

FIG. 8 is a bottom view looking up at the structure of FIG. 7, illustrating the overlap or interference of ears supplied the lower portion of the bracket body, even when the stirrup travels rearwardly, whereby to keep the stirrup in engagement with the bracket even though, through strata shift, slack is developed in the truss so as to produce a rearward travel of the stirrup; in FIG. 8 the phantom line, which is essentially horizontal, illustrates the quadrature relationship of the stirrup and mine roof bracket whereby the stirrup intentionally can be removed from or installed upon such bracket.

Figure 9:
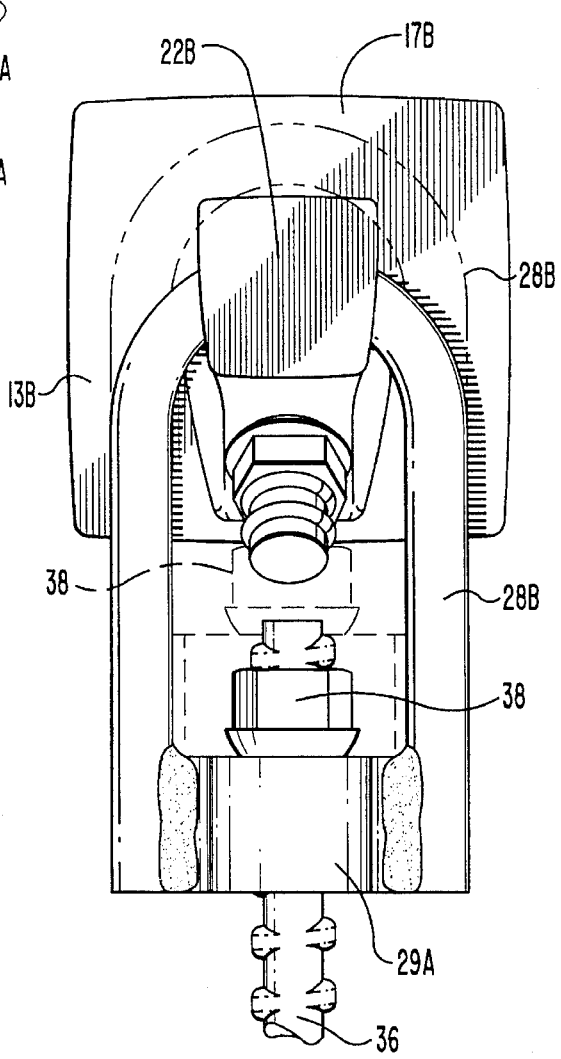

FIG. 9 is similar to FIG. 2 but illustrates an embodiment wherein the structure is foreshortened, whereby the structure presents a self-contained stop, of whatever form and constituted by whatever components, so as to delimit rearward sturrup travel relative to the mine roof bracket body.

Figure 10:
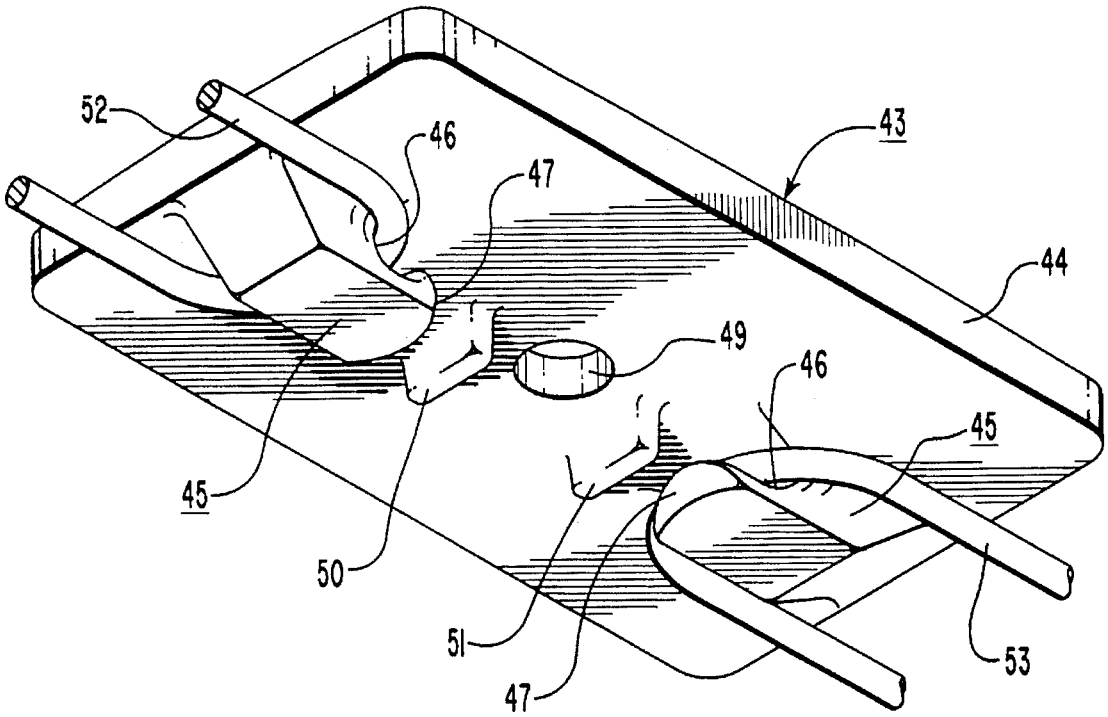

FIG. 10 is a perspective view of a mine bracket having plural body portion extensions provided with plural stirrup-travel-delimiting stop projections.

DETAILED DESCRIPTION OF PREFERRED EMBODIMENTS

Figure 3:
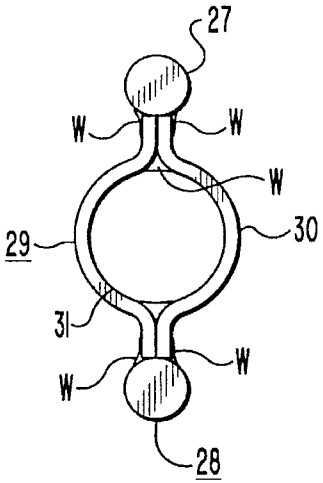
FIG. 3 is an end view of the right end of the structure of FIG. 2

In FIG. 1 mine roof strata 10 includes a roof surface 11 and also roof bolt admittance aperture 12. Mine bracket 13, generally a mine roof bracket, is secured in place by anchor bolt or roof bolt 14, anchored in aperture 12 as by conventional epoxy, point anchor, etc., in a customary manner, and provided with tightening nut 15 threaded thereon. Threads 16 are provided the bolt 14 to accommodate nut 15. Mine bracket 13 in FIGS. 1 and 2 is shown to included a bearing plate 17 and also a body 18 which is integral and/or fixedly disposed therewith and secured thereto. Where the mine bracket is cast, then bearing plate 17 and body 18 will comprises respective portions thereof. Body 18 includes a forward canted surface 19 which is provided with aperture 20. Aperture 20 is in line with aperture 21 of bearing plate 17, forming a composite aperture 20B (see FIG. 6) and thus is aligned with the aperture 12 of the mine roof strata. Body 18 includes a horizontal rearwardly oriented and extending lower portion 22 which, in the embodiment shown in FIGS. 1 and 2, is provided with an upstanding lip 23 in part forming cradle 24. Cradle 24 in turn is contiguous with a rearward indentation 25 that serves as a seat or stirrup mount reaction surface 25A for curved portion 26 of U-configured member 27. U-configured member 27 forms the principal part of a stirrup 28, the latter having an end fitting 29. End fitting 29, see FIG. 3, is preferably formed of a face-to-face disposed pair of curved, aperture forming elements 30 and 31. Elements 30 and 31 are welded together at W and also to the ends or extremities 32 and 33 of legs 34 and 35. Legs 34 and 35, with interconnecting medial portion 26, comprise the stirrup principal member or U-configured member 27 of stirrup 28. Stirrup 28 is brought into tension by the employment of a threaded tie rod 36 having threads 37 accommodating securement nut 38 which is threaded thereon. The remainder of truss T, comprised of the tie rod 36, bracket 13, and stirrup 28, is not shown (to the right of tie rod 36), but can comprise similar structure to that shown. Stirrup 28, with or without the inclusion of tie rod 36, may be thought of as a connector that loops around body 18 of mine bracket 13. In this regard, indentation 25 comprises a rearward pocket constituted by reaction surface 25A which is preferably concave in a vertical plane but arcutely convex in a horizontal plane; the edge surface thereof, therefore, is preferably convex to cooperate with the curved nature of medial portion 26 of stirrup 28.

Of special importance is the inclusion of a depending stop member or projection 39. The same projects downwardly and it is mutually spaced downwardly from the rearward indentation 25 or body 18 and also is spaced from upstanding lip 23. Thus, there is a passageway P which is provided for the selective reception and also disengagement of the stirrup 28 relative to the body 18 of the bracket 13. The contour and dimensions of medial portion 26 of the stirrup and the placement and extent of depending projection 39 are chosen such that, in the normal operating condition, there will be no disengagement of the stirrup 28 from body 18 of mine bracket 13 whatever the condition, intermittent shock or "bump" experienced by the mine strata. This is to say, if there is a strata shift or other strata disturbance tending to produce slack in the truss at T, yet the rearward movement of the stirrup 28 will be delimited by the positioning of and engagement with the stirrup of projection 39 so that there will be an overlap of portions of the lower portion 22 of body 18 relative to medial portion 26 of the stirrup. See in this regard FIG. 2, wherein it is clearly seen that when the stirrup advances to the phantom line condition shown at 28', a point at which the stirrup engages the depending stop member or projection 39, the lower portion will be of sufficient lateral dimension so as to be in interference with the dropping down of the stirrup 28 when the same assumes its position at 28'. FIG. 4 illustrates that in the situation wherein a decoupled stirrup 28 is to be removed from the bracket, it is simply advanced to the left to the position indicated in FIG. 5, wherein the right leg 34 is lifted upwardly and the user simply pulls toward himself the stirrup such that leg 35 advances out of passageway P. Assuming the reverse situation wherein the stirrup 28 is to be installed, the plane of the stirrup will be disposed normal to the surface S of bearing plate 17 and it is simply slipped downwardly, relative to FIG. 4, and then manipulated to a horizontal position, whereat, and owing to the rearward indentation 25, see FIG. 1, the stirrup can be twisted about a vertical axis 90 degrees to assume the position shown in FIGS. 1 and 2.

It is important to note that the vertically depending projection or stop at 39, in the embodiment shown in FIG. 2, is disposed rearwardly of reaction surface 25A of the body of the mine roof bracket 13. This is preferred and contributes to ease of designing the cooperating structures so that the stop serves to preclude unwanted disengagement of the stirrup 28 relative to body 18 during operative conditions of slack in the truss system. However, one or more projections 39B depending from the bearing plate 17 or associated structure can be employed, with or without projection 39, which need not be disposed rearwardly of lip 23 or reaction surface 25A, so long as the stop function is retained; i.e., there is an engagement of the stirrup relative to such stop structure for delimiting stirrup rearward travel whereby the inter-coupling of the stirrup with the bracket body is retained while the truss is installed and regardless of "bumps" or other stress experienced by the mine roof strata. Whatever and wherever the nature of the stops, however, they should be so placed and the complementary structure designed such as to provide for preliminary installation, and also desired intentional manual removal of the stirrup relative to the bracket body.

FIG. 6 illustrates that the mine bracket 13, generally comprising a mine roof bracket, includes a canted composite aperture 20B comprised of aligned apertures 20 and 28 relative to body 18 and bearing plate 17. Nut 15 in FIG. 6 secures the bracket 13 to and against bearing surface 11 of mine roof strata 10 in FIG. 1. Should it be desired to manipulate the stirrup 28 into a disengaged position relative to bracket 13, then the medial portion 26 of the stirrup is advanced in the direction of the arrows to the rearward position, thus abutting projection 36 as seen at 31, and then be dropped downwardly from A1 to the position shown at A2. The reverse case is also clearly possible. Thus, whether the mine bracket is mounted or is in a dismount condition, the medial portion, or even a leg 34, 35 of the stirrup can be advanced into passageway P and advanced from a position A2 to position A1 and thereafter turned and rotated so as to assume the normal installed position relative to stirrup 28.

A connector or tie rod receiving aperture 40 is formed by the curved, aperture-forming elements 30 and 31 in FIG. 3, to provide access for the threaded tie rod 36 in FIG. 1 and the securement thereof in place by means of nut 38.

FIGS. 7 and 8 illustrate an additional embodiment of the invention wherein the body, now 18A, of mine roof bracket 13A corresponding to mine roof bracket 13 in FIGS. 1 and 2, takes a slightly different form but does include aperture 20A. The stirrup 28 in its design can be essentially identical, the same incorporating the threaded tie rod 36 which is secured to other structure, not shown. End fitting 29 is of course welded as before to the U-configured member 27. As to the new bracket in FIGS. 7 and 8, namely bracket 13A, the same includes a bearing plate 17A and, depending therefrom, body 18A which is provided with rearwardly extending lower portion 22A. This time, the lower portion 22A, corresponding to lower portion 22 in FIG. 1, includes laterally extending ears or projections 41 and 42. The purpose for these projections will become clear upon reference to FIG. 8. Thus, should a jarring or "bump" occur effecting the mine strata so as to tend to produce slack in the mine truss, the rearward advancement of stirrup of 28 will be delimited by the inclusion of the stop 39A which corresponds to the stop or projection 39 in FIG. 1. It is noted that at this point the curved medial portion 26 will have advanced to 26A in FIG. 8. However, at this point the ears or extensions 41 and 42 will operate as an interference or retainer such that the stirrup in its customary orientation will be unable to drop out of pathway PA corresponding to passageway P in FIG. 1. Thus, there is no chance for the stirrup to become inadvertently disengaged relative to the mine bracket 13A. Of course, when the user desired either to assemble the stirrup onto the mine roof bracket or, alternatively, to remove the stirrup from the bracket, then the workman needs only to advance rearwardly stirrup 28 and then twist the same to the right or to the left relative to FIG. 8 and advance one of the legs upwardly to 90 degree orientation relative to the bearing plate 17A so that a leg can slip out of the passageway PA. Hence, at all events the passageway PA will be larger than that portion of the stirrup which is to be accommodated by it.

The phantom line configurement at 28A in FIG. 8, see also FIG. 7, illustrates the vertical orientation of the stirrup whereby the same can be slipped easily out of the path or passageway PA such that the stirrup can be either disengaged from or, alternatively, engaged with respect to the body 18A of mine roof bracket 13A.

FIG. 9 is another embodiment, similar to that shown in FIG. 2, but illustrates that the depending protrusions 39, 39B of FIG. 2 can conceivably be eliminated and, for example, the stirrup at 28B be foreshortened relative to stirrup 28 in FIG. 2 such that rearward travel of the stirrup is delimited by engagement of structure associated with said stirrup, i.e. see (in FIG. 9) 28B, 38, and end of connector 36, and structure associated with mine roof bracket 13B, 13, i.e. 14, 15, 18, and 19 (FIG. 1), which now has bearing plate 17B and lower portion 22B. According, and merely by way of example, when the nut 38 advances forward to engage a part of the structure associated with the bracket, then the outward travel of stirrup 28B is constrained as to maximum travel thereof to the position shown at the phantom lines above lower portion 22B in FIG. 4, thereby retaining an interference or stop relationship as between lower portion 22B of the mine roof bracket and portions of the curved portion of stirrup 28B. The embodiment discussed in this paragraph is feasible; however, other embodiments as shown and described are deem preferable from construction and operational standpoints.

The present invention likewise comprehends mine brackets having bearing plates with multiple, mutually spaced, depending body portions as in the various embodiments shown in prior U.S. Pat. No. 5,176,473. FIG. 10 herein illustrates, by way of example, the FIG. 9 embodiment of the above referenced patent—which is fully incorporated herein by way of reference—, but which now includes one or more depending stop projections cooperative with the depending body portions of the bracket. In FIG. 10, optional mine bracket 43 includes bearing plate 44 having depending body portions 45 integral therewith or secured thereto. The depending body portions are oppositely facing and include respective reaction surfaces 46 and upturned lips 47. The bearing plate is shown to include a central mounting aperture 49, and also depending stop projections 50 and 51, corresponding and operating in the same manner as stop projection 39 in FIG. 1. Other types of stirrup travel delimiting structures can be employed in lieu of or in addition to stop projections 50 and 51. In operation, stirrups 52 and 53, corresponding to stirrup 28 in FIG. 2, engage the respective body portions 45, and stirrup travel is constrained, i.e. by stop projections 50 and 51, to avoid inadvertent disengagement of the stirrups from such body portions. This invention of course comprehends all types of mine brackets having either singular or plural, lateral or depending body portions and provided stirrup travel delimiting structure.

As the above description reveals, therein here in the invention a particular method of providing trussing structure for stabilizing mine strata, comprising the steps of: (a) providing a mine bracket having a bearing plate portion and a body portion, provided a reaction surface indentation, extending laterally from said bearing plate; (b) mounting said mine bracket against desired mine strata; (c) providing and dimensioning a stirrup connector for encompassing said body portion and reactively engaging said body portion when in operative condition; and (d) providing at least one stop projection for said mine bracket, spaced from said reaction surface, whereby to admit the installation of said stirrup connector of about said body but abuttingly engaging said stirrup connector for delimiting rearward travel thereof, whereby to deter inadvertent disengagement of said stirrup with said bracket for operative condition of said trussing structure.

While particular embodiments of the present invention have been shown and described, it will be obvious to all those skilled in the art that various modifications and changes may be made in the invention without departing from the essential aspects thereof, and therefore the aim of appended claim is to cover all such changes and modifications as fall within the true spirit and scope of the invention.

I claim:

1. Mine strata support structure including, in combination: a mine bracket constituting a unitary cast part and including a bearing plate; a rigid body integral with and depending from said bearing plate, said body being provided with a pocket-forming connector-receiving indentation and having a lower portion disposed underneath said indentation; and a rigid connector-stop projection fixedly disposed with respect to said bearing plate and body, depending from said bearing plate, and mutually cooperatively spaced from said lower portion and said indention, said bearing plate and body being provided with aligned, respective mounting apertures; and a stirrup connector fitted over and selectively engaging said body at said indentation, said stirrup connector, body lower portion and connector-stop projection being mutually constructed and arranged to provide connector-stop-projection-delimiting stirrup-connector travel, relative to normal, horizontal, operative positioning of said stirrup connector, without chancing inadvertent stirrup-connector disengagement, and also to admit passage, in withdrawal, of said stirrup connector between said connector-stop-projection and said lower portion.

2. The support structure of claim 1 wherein said lower portion includes an upturned lip, forming with said indentation a connector cradle, the spacing between said lip and said connector-stop projection being sufficient to permit selective passage of said stirrup connector therethrough.

3. The support structure of claim 1 wherein said lower portion includes a pair of transverse, laterally outwardly extending stop-protuberances, the spacing between said stop protuberances and said rigid connector-stop projection being sufficient to permit intended withdrawal of said stirrup connector.

4. The support structure of claim 1 wherein said body has a forward face which is rearwardly canted, said apertures being canted, said body aperture passing in a direction normal to said face, and said connector stop being integral with and depending from said bearing plate.

5. In combination, an elongated connector having an interior cavity; a mine bracket comprising a bearing plate and a body integral with and depending from said bearing plate and provided with a rearward reaction surface and a rearwardly extending lower portion disposed beneath said reaction surface, said elongated connector being removably disposed about said body; and said mine bracket also including rigid projection means mutually spaced from said reaction surface and depending from said bearing plate for defining with said lower portion of said body an insertion- and also withdrawal travel path, in dimension greater than the nominal elemental cross-section of at least a portion of said elongated connector, whereby said connector can be brought into reactive engagement with said body at said reaction surface, and also withdrawal therefrom, but where said projection means deters unwanted disengagement of said connector with said body for operative dispositions of said connector and said bracket.

6. The combination of claim 5 wherein said elongated connector comprises a stirrup releasably mounted over said body, engaging said reaction surface, and comprising a U-shaped member comprising a curved medial portion and opposite leg portions integral therewith and provided opposite proximate ends, and an apertured end fitting secured to said opposite ends.

7. The combination of claim 5 wherein said rearwardly extending lower portion includes an upstanding lip spacedly disposed relative to said depending projection means.

8. The combination of claim 5 wherein said lower portion has laterally opposite extending protuberances disposed rearwardly of said curved medial portion of said U-shaped member.

9. The combination of claim 8 wherein said protuberances, depending projection means, and U-shaped member are constructed and dimensioned in a manner to deter undesired disengagement of said stirrup and bracket both during periods of portability and also installation.

10. The combination of claim 6 wherein said bracket and stirrup are dimensioned such that there is an interference between said lower portion of said bracket and said stirrup when said stirrup retracts to engage said depending projection means, for operative dispositions of said bracket and stirrup.

11. A method of providing trussing structure for stabilizing mine strata, comprising the steps of:

a. providing a mine bracket having a bearing plate portion and a body portion, providing a reaction surface indentation, extending laterally from said bearing plate;

b. mounting said mine bracket against desired mine strata;

c. providing and dimensioning a stirrup connector for encompassing said body portion and reactively engaging said body portion when in operative condition; and d. providing a rigid stop projection rigidly depending from said mine bracket, and spaced from said reaction surface and said body portion, whereby to admit the installation of said stirrup connector about said body but abuttingly engage said stirrup connector for delimiting rearward travel thereof, whereby to deter inadvertent disengagement of said stirrup with said bracket for operative conditions of said trussing structure.

12. A unitary, cast, mine bracket including, in combination, a bearing plate portion, a body integral with and depending from said bearing plate portion, said body having a rearward, indented reaction surface and a lower portion disposed beneath said reaction surface, means for cradling an external stirrup connector when the latter is suspended from said lower portion during portage, and rigid means, integral with said bearing plate portion and spaced from said reaction surface, for delimiting the rearward travel of said external stirrup connector during instances of aggravated mine strata conditions, said lower portion being so placed and dimensioned, relative to said stirrup connector, to deter the inadvertent disengagement of said stirrup connector with respect to said body portion.

13. An integral, cast, mine roof bracket comprising: a bearing plate portion, a body depending from said bearing plate portion and having a mounting aperture passing through said bearing plate portion, said body including a rearward indentation providing a connector reaction surface, and rigid stop projection means, fixedly depending from said bearing plate portion, for providing at least one connector-travel-delimiting stop abutment.

14. In combination, a stirrup having an open interior and first and second opposite ends, said first end being provided with reaction structure having an aperture communicating with said open interior, an elongated connector having opposite ends, one of said ends being received by said aperture, first nut means for securing said one end with respect to said reaction structure; a mine bracket having a bearing plate portion and a body portion mountedly receiving said stirrup interior of said second end and depending from said bearing plate portion, said mine bracket having a mounting aperture proceeding through said bearing plate portion and said body portion, said body portion having a rearward indentation forming a stirrup-engaging reaction surface continuing as a rearwardly extending, lower, stirrup-support portion disposed beneath and rearwardly of said indentation; an anchor bolt passing through said aperture of said mine bracket and provided with second nut means threaded thereon and abutting said mine bracket for securing said mine bracket in place; and at least one of said second nut means, body portion and anchor bolt comprising rigid stop means, dimensioned and positioned for operative longitudinal clearance with respect to but engagable with at least one of said stirrup, said first nut means, and said one end of said elongated connector, for delimiting the extent of rearward travel of said stirrup, when in its operative horizontal position, relative to said mine bracket beyond stirrup engagement with said stirrup-support portion, whereby said stirrup at said second end thereof is thus deterred from rearward travel beyond a position of support by said rearwardly extending, lower, stirrup-support portion of said body portion of said mine bracket.

15. In combination, a mine roof bracket provided with a depending, stirrup engaging body portion, said body portion having a lower, horizontally and rearwardly extending lower portion; an operationally, essentially horizontally disposed stirrup connector positioned over and engaging said stirrup engaging body portion, and fixed, rigid means structurally related to said body portion and said stirrup connector and dimensioned and positioned for delimiting inadvertent rearward travel of said horizontally disposed stirrup connector, relative to said body portion, beyond engagement with said rearwardly extending lower portion, in a manner as to chance unwanted disengagement of said stirrup connector with said mine roof bracket.

16. In combination, a unitary, cast, mine roof bracket provided with a depending, stirrup connector engaging body portion and a bearing plate portion disposed thereover; an operationally, essentially horizontally disposed stirrup connector positioned over and engaging said body portion, said bearing plate portion having at least one rigid, fixed depending projection means selectively engageable with said stirrup connector for delimiting rearward, stirrup connector travel relative to said mine roof bracket, whereby to avoid unwanted disengagement of said stirrup connector with said body portion in the event of slack occuring as between said mine roof bracket and said stirrup connector.

17. A unitary, cast, mine bracket having a mounting aperture and comprising: a bearing plate; a body laterally extending from and fixedly disposed with respect to said bearing plate, said body being provided with a connector-engaging reaction surface; and a rigid, fixed stop projection means depending from said bearing plate and mutually spaced from said reaction surface for delimiting travel extent of any selected external connector disposed over said body.

18. A mine bracket constituting a unitary cast part and comprising a bearing plate having an exterior edge periphery; plural, mutually spaced body portions depending from said bearing plate; and plural rigid stop means mutually and respectively spaced from said body portions and likewise depending from said bearing plate at respective regions thereof which are interior of said exterior edge periphery, for deterring inadvertent disengagement of external elongated connectors from said body portions when said connectors are respectively mounted thereto, said body portions having connector-receiving cavities respectively facing generally toward each other interiorly with respect to said exterior edge periphery.

19. A one piece mine bracket comprising a bearing plate, at least one body portion extending laterally from said bearing plate and having an elongated connector mount reaction surface, the combination of said bearing plate and said body portion having a rigid projection spaced from and cooperable with said said reaction surface for constraining movement of an external elongated connector when mounted over said body portion.

* * * * *